United States Patent [19]

Boesch et al.

[11] 4,190,437

[45] Feb. 26, 1980

[54] LOW THERMAL EXPANSION NICKEL-IRON BASE ALLOY

[75] Inventors: William J. Boesch, Utica; Gernant E. Maurer, New Hartford, both of N.Y.

[73] Assignee: Special Metals Corporation, New Hartford, N.Y.

[21] Appl. No.: 6,715

[22] Filed: Jan. 26, 1979

Related U.S. Application Data

[63] Continuation-in-part of Ser. No. 858,590, Dec. 8, 1977, abandoned.

[51] Int. Cl.[2] ..... C22C 38/08; C22C 38/10

[52] U.S. Cl. ..... 75/122; 75/123 J; 75/123 K; 75/124; 75/134 F; 428/616; 428/619

[58] Field of Search ..... 75/123 K, 123 B, 123 J, 75/122, 134 F, 170, 124, 123 R; 428/616, 619

[56] References Cited

U.S. PATENT DOCUMENTS

| | | | |
|---|---|---|---|
| 3,157,495 | 11/1964 | Elselstein et al. | 75/134 F |
| 3,705,827 | 12/1972 | Muzyka et al. | 75/123 K |
| 3,900,316 | 8/1975 | Jones | 75/128 F |
| 3,902,899 | 9/1975 | Sponseller | 75/128 F |
| 4,006,011 | 2/1977 | Muzyka et al. | 75/123 K |
| 4,006,012 | 2/1977 | Kindlimann | 75/122 |
| 4,012,227 | 3/1977 | Jones et al. | 75/122 |
| 4,066,447 | 1/1978 | Smith, Jr. et al. | 75/134 F |

*Primary Examiner*—Arthur J. Steiner

*Attorney, Agent, or Firm*—Vincent G. Gioia; Robert F. Dropkin

[57] ABSTRACT

A castable nickel-iron base alloy suitable for high temperature service and characterized by low thermal expansion and freedom from notch sensitivity and deleterious microshrinkage in castings. The alloy consists essentially of at least 16% nickel, at least 10% cobalt, up to 5% columbium, up to 3% tantalum, up to 2.5% titanium, up to 2% aluminum, 0.06% to 0.25% boron, up to 0.1% carbon, and the balance iron.

14 Claims, 4 Drawing Figures

LOW THERMAL EXPANSION NICKEL-IRON BASE ALLOY

CROSS-REFERENCE TO RELATED APPLICATION

This is a continuation-in-part of application Ser. No. 858,590, filed Dec. 8, 1977 now abandoned.

BACKGROUND OF THE INVENTION

In the past, iron-nickel alloys have been developed having extremely low thermal expansion coefficients which enable them to be used over wide temperature ranges without losing strength and without any substantial change in elasticity. Examples of such alloys are given in U.S. Pat. Nos. 3,157,495 and 4,006,011 and typically contain controlled amounts of cobalt, columbium and titanium. They are used in such applications as rocket engine parts and the like which must have superior resistance to thermal fatigue. A difficulty with alloys of this type, however, is their notch sensitivity and severe microshrinkage upon cooling from the molten state. As a result, they have not been used in the cast form.

SUMMARY OF THE INVENTION

The present invention resides in the discovery that critical amounts of boron can be added to nickel-iron base alloys of the type described above to eliminate notch sensitivity and deleterious microshrinkage in castings. At the same time, the alloy retains its low thermal expansion characteristics. Specifically, it has been found that the addition of about 0.06% to 0.25% boron to certain types of iron-nickel base alloys will promote the formation of a eutectic boride during solidification; and it is the presence of this eutectic boride which improves castability of the alloy. Alloys of this type are characterized by a wide liquidus to solidus range and can be cast or hot-worked and used in wrought form, provided that a suitable heat treatment for the wrought form is provided.

Figure 1A:
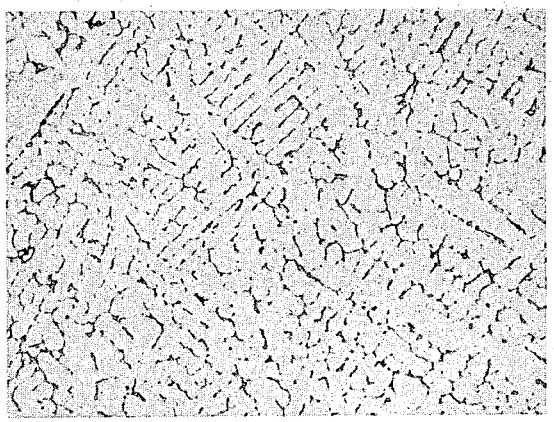
Figure 1B:
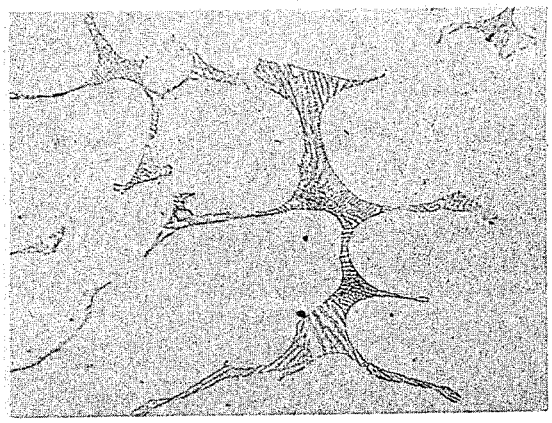
Figure 2A:
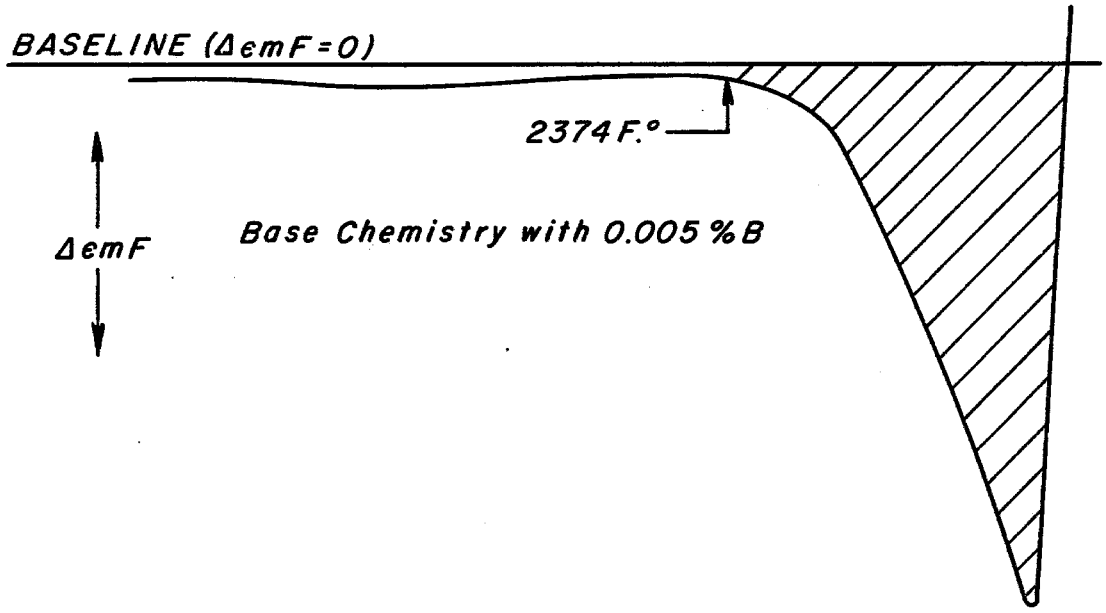
Figure 2B:
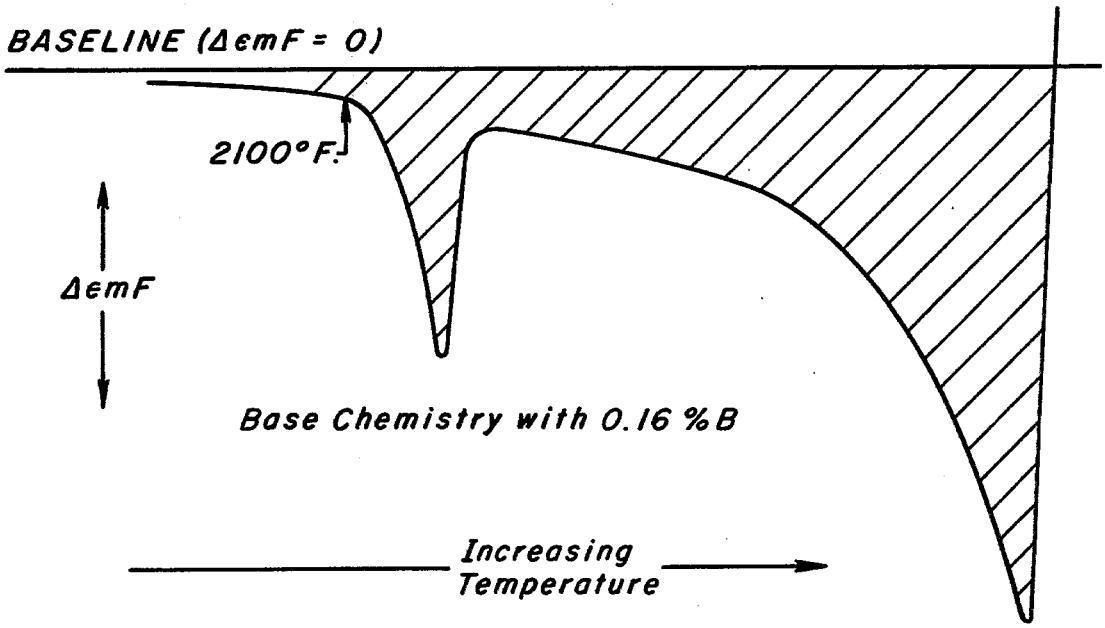

The above and other objects and features of the invention will become apparent from the following detailed description taken in connection with the accompanying drawings which form a part of this specification, and in which:

FIGS. 1A and 1B are photomicrographs at magnifications of 50X and 400X, respectively, showing the formation of a eutectic boride in the alloy of the invention; and FIGS. 2A and 2B are differential thermal analysis plots showing the effect of variation in boron in the alloy of the invention upon the solidus temperature.

The alloy of the invention has the following broad and preferred ranges of composition:

TABLE I

| | Broad | Preferred |
|---|---|---|
| Nickel | at least 16% | 30–50% |
| Cobalt | at least 10% | 10–20% |
| Columbium | 0–5% | 2–4% |
| Tantalum | 0–3% | 0–1% |
| Titanium | 0–2.5% | 1–2% |
| Aluminum | 0–2% | .25–1% |
| Boron | at least .06% | .06–.30% |
| Carbon | 0–.1% | .015–.045% |
| Iron | Bal. | Bal. |

The carbon should be kept as low as possible in order that it will not produce carbide clusters in the boride eutectic about to be described. Additionally, the alloy can contain up to 0.1% zirconium which is desirable to impede the formation of $Ni_3Cb$ at the grain boundaries of the alloy. Up to 0.1% of rare earths can be added which act as scavengers to prevent deleterious sulfide formations and the formation of acicular phases; while up to 1% hafnium can be added which acts as a carbide former and widens the liquidus to solidus temperature range. The alloy may also contain up to 0.1% of elements from the group consisting of magnesium, calcium, strontium and barium, up to 3% molybdenum and up to 3% tungsten. Group II A elements, such as magnesium, may be added as they are scavengers of deleterious sulfur. Molybdenum and tungsten are useful as solid solution strengtheners. As is known, small amounts of tantalum are often associated with columbium obtained from commercial sources. Normally, these small amounts of tantalum occur in amounts up to about 3% of the total content of columbium plus tantalum. As used in the following claims, therefore, the term "columbium" means pure columbium (if it is available) or columbium plus certain amounts of tantalum. A certain amount of the columbium content, however, can be replaced by pure tantalum in the ratio of two parts tantalum to one part columbium.

As will be seen from the following description, alloys in the foregoing range of composition have low thermal expansion characteristics and are free of notch sensitivity, making them especially available for use as an alloy used in castings intended for use over a wide temperature range.

Properties of the new and improved alloy of the invention are established by the following Table II which shows the analysis of five different heats having varying amounts of boron additions:

TABLE II

| Heat | Analysis (Aim) | | | | | | | |
|---|---|---|---|---|---|---|---|---|
| No. | C | B | Ni | Co | Cb | Ti | Al | Fe |
| D1-939 | 0.03 | 0.005 | 38.2 | 15.3 | 3.0 | 1.7 | 0.8 | Bal. |
| D1-940 | 0.03 | 0.050 | 38.2 | 15.3 | 3.0 | 1.7 | 0.8 | Bal. |
| D1-979 | 0.02 | 0.100 | 38.2 | 15.3 | 3.0 | 1.7 | 0.8 | Bal. |
| D1-1032 | 0.02 | 0.160 | 38.2 | 15.3 | 3.0 | 1.7 | 0.8 | Bal. |
| D1-1287 | 0.02 | 0.300 | 38.2 | 15.3 | 3.0 | 1.7 | 0.8 | Bal. |

Heat No. Dl-939 is a standard prior art alloy similar to that described in the aforesaid U.S. Pat No. 3,157,495. An alloy of this type is characterized by a mircrostructure which shows no eutectic boride phase and contains large amounts of porosity which leads to poor stress rupture life. All of the heats in the foregoing Table II were cast in investment molds to yield test bars. These bars were then heat-treated and machined to 0.250 inch diameter bars which were subsequently stress rupture tested. The results of the stress rupture tests are shown in the following Table III:

TABLE III

| | Stress Rupture (1200° F./90 Ksi) | | | |
|---|---|---|---|---|
| Heat No. | Boron** (Wt. %) | Life (Hrs) | Elong. (%) | R.A. (%) |
| D1-939 | 0.0052 | 0.2 | 2.0 | 9.2 |
| D1-940 | 0.050 | 0.7 | 1.3 | 6.9 |
| D1-979 | 0.094 | 66.2 | 3.9 | 6.7 |
| DI-1032 | 0.156 | 138.5 | 8.0 | 9.7 |

TABLE III-continued

| Heat No. | Boron** (Wt. %) | Stress Rupture (1200° F./90 Ksi) Life (Hrs) | Elong. (%) | R.A. (%) |
|---|---|---|---|---|
| Dl-1032* | 0.156 | 172.2 | 8.2 | 11.2 |

*Combination smooth tensile bar and notched tensile bar.
**Actual Wt. % as contrasted with aim of Table II.

As can be seen from the foregoing Table III, the standard prior art alloy Dl-939 containing only 0.0052% boron has a stress rupture life of only 0.2 hour at 1200° F./90 Ksi with a 2% elongation and 9.2% reduction in area. Further additions of boron up to 0.050% (Heat Dl-940) have very little effect on the stress rupture life which increases to only 0.7% at 1.3% elongation and 6.9% reduction in area. However in Heat Dl-979 with a boron addition of 0.094%, stress rupture life under the same conditions is dramatically increased to 66.2 hours at 3.9% elongation and 6.7% reduction in area. Boron additions of 0.156% (Heat Dl-1032) more than double the stress rupture life to 138.5 hours at 8% elongation and 9.7% reduction in area. Heat Dl-1032* is the same as that previously described except that the test specimen was a combination smooth tensile bar and notched tensile bar. Here the stress rupture life is further increased.

As shown in FIGS. 1A and 1B, photomicrographs of the alloy of Heat Dl-1032 containing 0.16% boron shows large amounts of eutectic boride and exhibits freedom from deleterious microshrinkage. It has an average thermal coefficient of expansion of about $4.7\times10^{-6}$ in/in/°F. at room temperature to 800° F. It is believed that the alloy of the invention derives its improved castability through the formation of eutectic boride during solidification.

The stress rupture characteristics of Heat Dl-1287 (Table II) containing 0.3% boron were not determined; however photomicrographs of this alloy show the same large amounts of eutectic boride. It is believed that boron additions materially above 0.3% will cause the volume of the inner dendritic eutectic to become excessive, resulting in large crack paths which could impair the physical properties of the alloy.

The difference in solidification characteristics of this alloy as compared to prior art alloys is shown in the thermal diagrams of FIGS. 2A and 2B. The upper diagram (FIG. 2A) is for a conventional prior art nickel-iron alloy containing 0.005% boron (Heat Dl-939); while the diagram of FIGS. 2B is for Heat Dl-1032 containing 0.16% boron. Note that the alloy of the invention containing boron is characterized by a wider liquidus to solidus range.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. An alloy suitable for high temperature service and characterized by low thermal expansion and substantial freedom from notch sensitivity and deleterious microshrinkage, consisting essentially of 30 to 50% nickel, 10 to 20% cobalt, up to 5% columbium, up to 3% tantalum, up to 2.5% titanium, up to 0.1% carbon, up to 2.0% aluminum, 0.06 to 0.3% boron, up to 0.1% zirconium, up to 0.1% rare earth elements, up to 1.0% hafnium, balance essentially iron, the alloy being characterized in containing a eutectic boride.

2. An alloy according to claim 1, having from 2 to 4% columbium.

3. An alloy according to claim 1, having from 1 to 2% titanium.

4. An alloy according to claim 1, having from 0.25 to 1% aluminum.

5. An alloy according to claim 1, having from 2 to 4% columbium, 1 to 2% titanium and 0.25 to 1% aluminum.

6. An alloy according to claim 1, having up to 1% tantalum.

7. An alloy according to claim 1, having from 0.15 to 0.045% carbon.

8. An alloy suitable for high temperature service and characterized by low thermal expansion and substantial freedom from notch sensitivity and deleterious microshrinkage, consisting essentially of 30 to 50% nickel, 10 to 20% cobalt, up to 5% columbium, up to 3% tantalum, up to 2.5% titanium, up to 0.1% carbon, up to 2.0% aluminum, 0.06 to 0.3% boron, up to 0.1% zirconium, up to 0.1% rare earth elements, up to 1.0% hafnium, up to 0.1% of elements from the group consisting of magnesium, calcium, strontium and barium, up to 3% molybdenum, up to 3% tungsten, balance essentially iron, the alloy being characterized in containing a eutectic boride.

9. An alloy according to claim 8, having from 2 to 4% columbium.

10. An alloy according to claim 8, having from 1 to 2% titanium.

11. An alloy according to claim 8, having from 0.25 to 1% aluminum.

12. An alloy according to claim 8, having from 2 to 4% columbium, 1 to 2% titanium and 0.25 to 1% aluminum.

13. An alloy according to claim 8, having up to 1% tantalum.

14. An alloy according to claim 8, having from 0.015 to 0.045% carbon.

* * * * *